United States Patent [19]

Morell et al.

[11] Patent Number: 4,709,491

[45] Date of Patent: Dec. 1, 1987

[54] ALPINE SKI BOOT

[75] Inventors: Joseph Morell, Annecy; Jean-Louis De Marchi, Duingt; Norbert Kopp, Chavanod, all of France

[73] Assignee: Salomon S.A., Annecy, France

[21] Appl. No.: 869,245

[22] Filed: Jun. 2, 1986

[30] Foreign Application Priority Data

Jun. 12, 1985 [FR] France ..... 85 09178

[51] Int. Cl.[4] ..... A43B 5/04

[52] U.S. Cl. ..... 36/121; 36/120

[58] Field of Search ..... 36/117–121

[56] References Cited

U.S. PATENT DOCUMENTS

| | | | |
|---|---|---|---|
| 3,633,291 | 1/1972 | Caporicci | 36/121 |
| 4,199,879 | 4/1980 | Wegeng . | |
| 4,570,364 | 2/1986 | Walkhoff | 36/121 |

FOREIGN PATENT DOCUMENTS

| | | | |
|---|---|---|---|
| 0053339 | 6/1982 | European Pat. Off. | 36/117 |
| 2057094 | 5/1972 | Fed. Rep. of Germany | 36/117 |
| 3044052 | 6/1982 | Fed. Rep. of Germany . | |
| 3529209 | 2/1986 | Fed. Rep. of Germany | 36/117 |
| 2096248 | 2/1972 | France . | |
| 2100490 | 3/1972 | France . | |
| 2103171 | 4/1972 | France . | |
| 2278280 | 2/1976 | France . | |
| 2342040 | 9/1977 | France . | |
| 2416661 | 9/1979 | France . | |
| 2495901 | 6/1982 | France . | |
| 2557776 | 7/1985 | France | 36/117 |

*Primary Examiner*—James Kee Chi

*Attorney, Agent, or Firm*—Sandler & Greenblum

[57] ABSTRACT

A ski boot including an upper journalled around a transverse axis on a rigid shell base. Also provided is an apparatus for determining the advancement angle of the upper, that is the angle which the upper forms with a vertical axis when at rest. In addition, the boot is adapted to flex forward from this advancement angle during skiing. The apparatus determining the advancement angle also determines the resistance moment of the boot to forward flexion from the advancement angle. This apparatus is an elastic apparatus integral with the shell base and the upper and extending between these two boot portions. The point of connection between the elastic apparatus and one of the two boot portions is adjustable between four positions. As a result, the length of the lever arm of the resistance moment of the boot can be varied by changing the point of connection of the elastic apparatus with one of these boot portions between these four positions, thereby providing a large number of different values for the rigidity of the boot.

54 Claims, 9 Drawing Figures

FIG. 1.
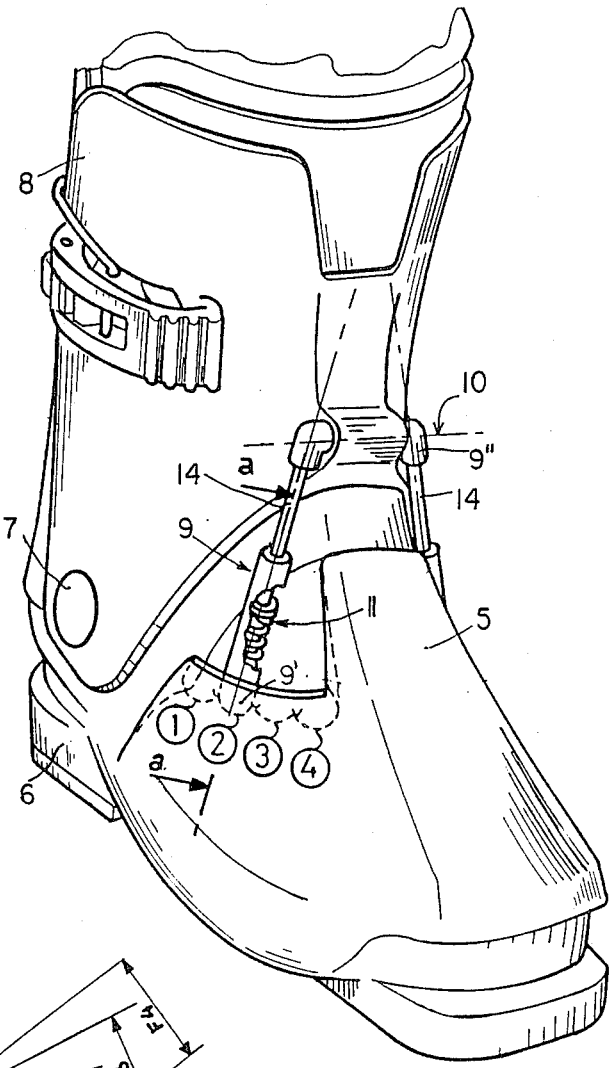
FIG. 1a.
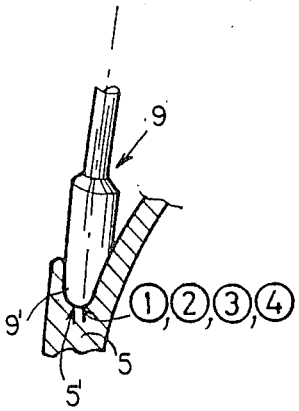
FIG. 2.
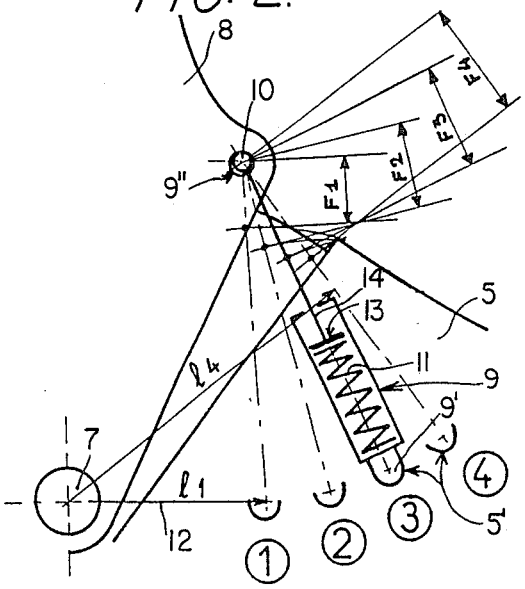
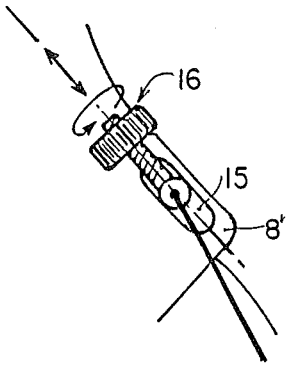
FIG. 2a.

FIG. 3.
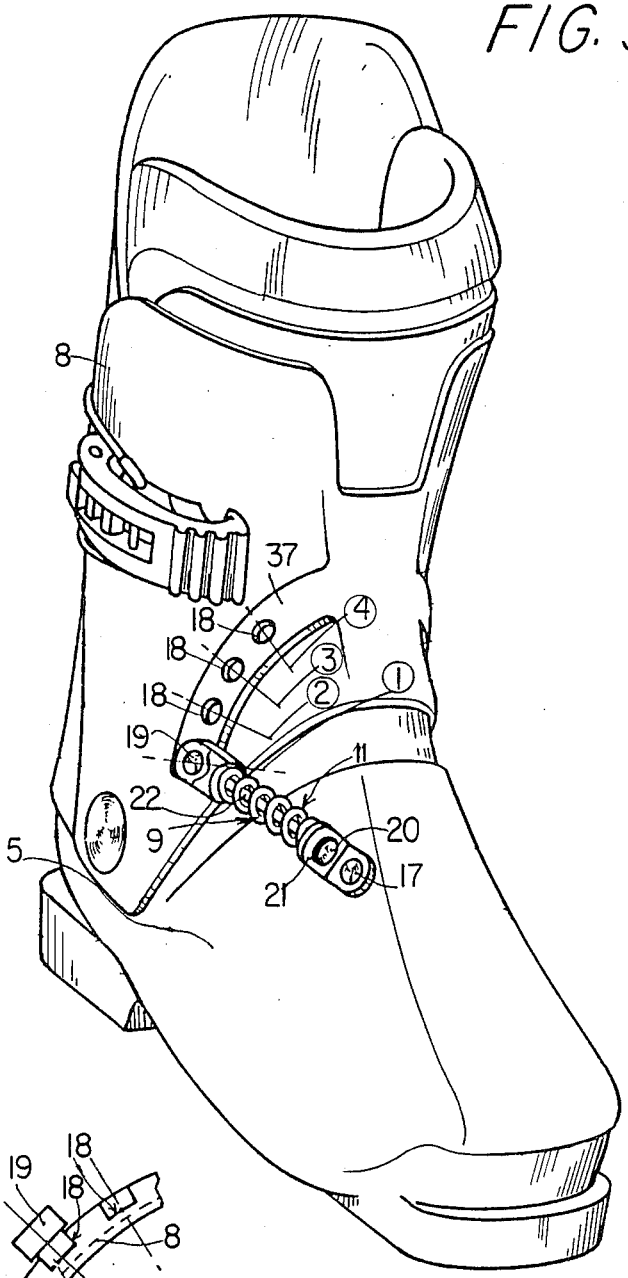
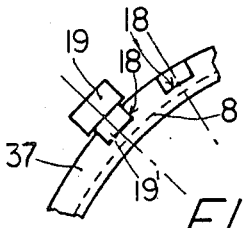
FIG. 3a.

FIG. 5.
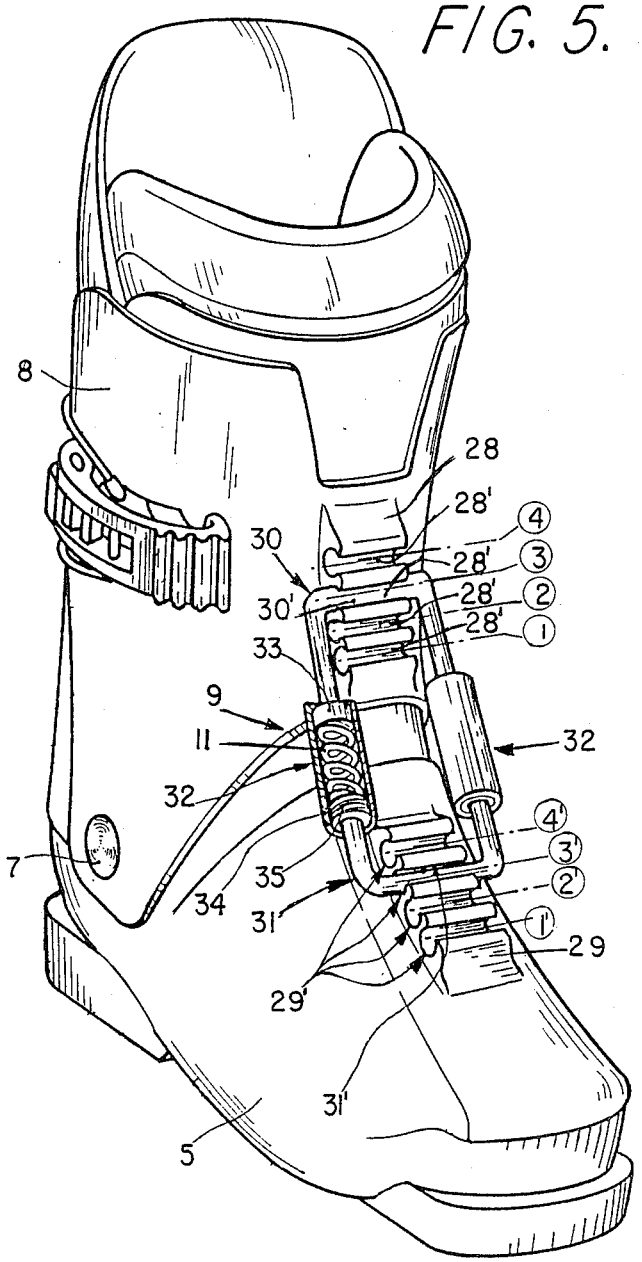
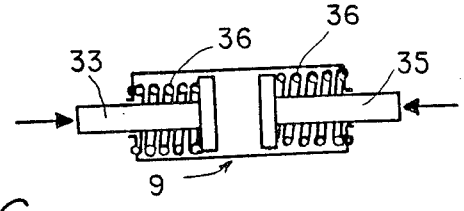
FIG. 6.

ALPINE SKI BOOT

BACKGROUND OF THE INVENTION

1. Field of the Invention

The present invention relates to boots for alpine skiing of the type which comprises an upper surrounding the lower leg of the skier, and a rigid shell base on which the upper is mounted.

2. Description of Relevant Information

Alpine ski boots are generally made of molded plastic material, and comprise a shell base surrounding the foot and an upper surrounding the lower leg of the skier. The upper comprises a cuff and a rear spoiler. These portions of the upper may be journalled, if desired, on the shell base around a transverse journal axis. A journal axis need not, where necessary, be physically present but the upper must be able to flex with respect to the shell base at least to certain degree, depending upon the conditions of use, so as to form the equivalent of a journal.

The general direction in which the upper extends called for reasons of simplicity, "the axis of the upper", is inclined frontwardly (with respect to a vertical axis passing through the shell base) by a certain angle known as the "advancement angle". From this advancement angle the boot must be constructed so that the skier can flex his leg frontwardly along a flexion angle. This advancement angle can be varied around an average value, depending upon the given circumstances of use because the upper can be journalled on the shell base. If the skier is often flexing the boot beyond the advancement angle, it is desirable to increase the advancement angle. In alpine skiing the optimal advancement angle is on the order of 13°–20° and sometimes may even reach 25°, while for the touring skier, an angle of 8°–15° is generally considered optimal. Furthermore, depending upon the type of skiing practiced and the state of the snow, the skier will require more or less flexibility in journalling the upper on the shell base, i.e., the skier will require greater or less difficulty in sweeping his leg forward from the advancement angle. Thus, one needs a sufficiently high stiffness for competition on hard snow or ice, and sufficient flexibility on powder snow and during descent so as to support oneself and to arrange one's muscles to achieve a flat skiing position.

These considerations are manifested by the need more and more skiers have for boots which not only have an average advancement angle corresponding to their personal criteria, but which also have means for controlling the flexion of the upper on the shell base. This allows the the boot to vary the resistance moment of the upper opposing the flexion of the leg of the skier on the upper, thereby increasing the comfort and safety of the user.

Numerous attempts have been made to satisfy these requirements by apparatus which control the flexion of the boot. For example, French Pat. Nos. 2 100 490 and 2 416 661, disclose a shock absorption apparatus having a simple or double effect spring anchored between a central point situated at an elevated position on the front of the cuff and a central point situated towards the front of the foot on the rigid shell base or integral with the rigid shell base. However, these apparatus have an unattractive appearance, they are very cumbersome and are exposed to shocks and to anything the skier encounters during movement of the ski, thereby increasing the probability that the boot will become caught on objects the skier encounters. As a result, these apparatus present a possible danger to the skier and their reliability is entirely uncertain.

French Application No. 2 278 280 discloses an apparatus which acts as an accessory to the boot and partially performs the desired functions noted above. However, it requires removable linkage elements between the rigid shell base and the cuff. The cuff pivots with respect to an element of the boot, which in the field of the present invention would be called a rear spoiler, because the entry into the boot occurs from the front. This apparatus placed at the rear of the boot, only flexes by virtue of its elasticity because this boot has no journal defining a transverse axis around which the the cuff can pivot on the rigid shell base. This solution is thus foreign to the present technical domain of the present invention which relates to an upper which is journalled on a shell base, and which opens rearwardly to permit the skier's foot to enter the boot.

These two apparatus discussed above perform their functions only in a longitudinal vertical plane or one which is approximately in a longitudinal vertical plane. As a result, these apparatus do not affect the flexion of the boot at the flexion fold or the instep of the boot.

Similar apparatus are described in German Application DE-OS No. 30 44 052, which discloses a spring anchored at the two points discussed in the applications discussed above, and French Application No. 2 495 901, in which where a double flexion blade is also anchored at the two end points noted above in the other applications.

Another solution is proposed by French Application No. 2 342 040. In this application an elongated support element is described which is fixed at one end on the front abutment of the binding of the boot and has at its other end a projecting portion which is introduced between two buckles whose position on the boot is adjustable, so as to limit the advancement position of the upper of the boot.

French Pat. Nos. 2 096 248 and 2 103 171 disclose a boot comprising compression or tension springs positioned in the longitudinal direction between the cuff and shell base and attached to pivot at their ends or points of application on these elements, directly or by means of an intermediary element. The former patent, however, is directed to the adjustment of the advancement angle of the upper and not to flexion control. Further, this device is apparently considered an accessory, and its elements are made of rubber serving to absorb excessive frontward pressures. The latter patent is not directed to the control of flexion, but only to absorbing shocks so as to obtain a soft transmission of the shocks between the foot and the ski. These springs serve to resist flexion of the foot, but being interchangeable, any modification of the resistance force necessitates a disassembly and reassembly of the apparatus, which is practically impossible on site.

In all of these cases the solutions proposed, whose number alone illustrates the importance and difficulty of the problem, have at least one and generally a number of notable insufficiencies in common: poor or doubtful effectiveness; complexity, which leads to prohibitively high costs; the ability to limit only the maximum advancement or flexion of the upper; and the adjustment of the apparatus can be made only once before skiing, which results in a loss of progressiveness as the leg flexes and which is inadequate under actual conditions.

An important step was made in overcoming these disadvantages in French Application No. 84.13152. This patent discloses an apparatus on the ski boot which permits flexion of the upper with respect to the shell base. The apparatus is effectively adjustable, depending upon the needs of the skier, before beginning skiing. Further, the apparatus has real progressiveness during skiing, which is controlled by the instantaneous conditions of use, and prevents extreme flexions damaging to the leg as a result of the anatomy of the leg. In addition, the apparatus absorbs shocks from the flexional forces via its elastic return, which is also sufficient for forces of lesser amplitude. In this apparatus, a flexional element positioned in the longitudinal direction between the shell base and the cuff is connected at one end to one of these elements and slidingly engages a ramp carried by the other of these elements. An adjustment element is provided to vary the flexional performance of the boot in a ratio which can be, for example, 1 to 2. This very high performance boot is very technically complex and an aesthetic integration of the apparatus into the general configuration of the boot is only barely achieved resulting in a substantial increase in production costs. Also, the boot appears to be designed for use by skiers who are very demanding, who have a very high skill level, and for whom price is not the primary consideration.

Therefore, there is a need for a boot whose flexional characteristics can be adjusted, depending upon the needs of the skier, before skiing, and which varies the resistance to flexion instantaneously depending upon conditions of use. Further, there is a need for a boot that also limits flexion that would be harmful to the leg, and which, at the same time is simpler in construction, and therefore, lower in cost, so as to make it available to a wider segment of the public.

SUMMARY OF THE INVENTION

It is an object of the present invention to provide a boot whose flexional characteristics can be adjusted, depending upon the needs of the skier, before skiing, and which varies the resistance to flexion instantaneously depending upon conditions of use.

It is another object of the present invention to provide a boot which also limits flexion that would be harmful to the leg, and which, at the same time is simpler in construction, and therefore, lower in cost, so as to make it available to a wider segment of the public.

It is still another object of the present invention is to provide a boot having flexional rigidity characteristics comparable in their order of magnitude to those of the boot which has just been described above, but which uses a simpler means of implementing those flexional characteristics. As a result, the cost of the boot is reduced which will make it available to a larger segment of the public.

Another object of the present invention is to provide a boot whose upper produces a resistance moment opposing the force exerted by the skier on the upper. The resistance moment varies as a function of the orientation of the leg of the skier.

Still another object of the present invention is to obtain this technical result by relying upon means similar to those described in the last two documents discussed above.

These and other objects of the present invention are accomplished by a ski boot surrounding the foot and lower leg of a skier. The boot comprises a shell base portion, an upper portion which is adapted to flex with respect to the shell base portion, and an elastic apparatus for controlling the flexion of the upper portion. The elastic apparatus is integral with each of the portions at a connection point. The elastic apparatus generates an elastic force directed toward the connection point of the elastic apparatus with one of the portions of the boot. The position of the connection point of the elastic apparatus with the other of the portions of tht boot is adjustable.

The boot can further comprises means for adjusting the connection point of the elastic apparatus with the other of the portions of the boot. The other of the portions of the boot comprises a plurality of spaced apart elements, each of which is adapted to receive a complementary shaped portion of the elastic apparatus. In one embodiment the plurality of spaced apart elements each comprises a groove adapted to receive a complementary shaped portion of the elastic apparatus.

The upper portion is adapted to be positioned with respect to the shell base portion at an advancement angle forming an angle with respect to a vertical axis. The upper portion is adapted to flex away from the advancement angle in response to a force from the leg of the skier. In addition, the elastic apparatus generates an elastic force directed toward the connection point of the elastic apparatus with one of the portions of the boot for a given advancement angle of the upper portion with respect to the shell base portion. In addition, the boot comprises a rear portion, and the upper portion is journalled at least partially on the shell base portion around a substantially horizontal axis. The upper portion comprises at least a portion surrounding the front of the lower leg of the skier, and the boot further comprises means for permitting insertion of the foot of the skier from the rear portion of the boot.

In one embodiment the elastic apparatus comprises at least one spring and at least one piston engaging the at least one spring. The elastic apparatus has a longitudinal axis extending through the at least one spring and the at least one piston. This longitudinal axis defines the line of application of a given orientation of the elastic force of the elastic apparatus to at least one of the boot portions. The elastic force opposes the flexion of the lower leg of the skier and the consequent flexion of the upper portion of the boot.

The elastic apparatus can further comprise a jack housing the at least one spring and the at least one piston, and a shaft attached to the piston and extending out of the jack such that the longitudinal axis extends through the shaft.

In one embodiment the elastic apparatus comprises an elastic compression spring, and in another embodiment the elastic apparatus comprises an extension spring.

In both of these embodiments the position of the connection point of the elastic apparatus with the other of the portions of the boot is adjustable to four different positions on the other portion of the boot.

The boot further comprising a transverse journal positioned at the connection point between the elastic apparatus and one of the portions of the boot. The elastic apparatus is pivotally connected to the one of the portions of the boot by the transverse journal. In addition, the boot can further comprise means for adjusting the height of the transverse journal. In one embodiment the one of the portions of the boot comprises the upper portion. In this embodiment the other of the portions of the boot comprises the shell base portion, and the adjusting means adjusts the height of the transverse journal along the front of the upper portion of the boot. Also, the shell base portion comprises a plurality of spaced apart grooves, each of which is adapted to receive one end of the elastic apparatus so that each of the grooves comprises a connection point of the elastic apparatus on the shell base portion. In an alternative embodiment the one of the portions of the boot comprises the shell base portion and the other of the portions of the boot comprises the upper portion. In this alternative embodiment the means for adjusting the height of the transverse journal, adjusts the height of the transverse journal along the front of the shell base portion. Also in this embodiment the upper portion of the boot comprises a plurality of spaced apart grooves, each of which is adapted to receive one end of the elastic apparatus so that each of the grooves comprises a connection point of the elastic apparatus on the upper portion of the boot.

In still another embodiment the shell base portion comprises a plurality of spaced apart grooves, and the elastic apparatus comprises a stirrup having the form substantially of three sides of a trapezoid. The stirrup comprises a minor base and two sides. The minor base comprises the transverse journal, which is integral with the upper portion of the boot. In addition, each of the two sides comprises a guidance shaft and a spring attached to the guidance shaft. Each guidance shaft extends from the transverse journal downwardly toward the bottom of a different side of the shell base portion toward one of the grooves.

In addition, the upper portion of the boot comprises a rib having an oblong slot therein. Further, the boot further comprises means for adjusting the height of the transverse journal along the the front of the upper portion of the boot such that the adjusting means comprises means for translationally displacing the transverse journal in the slot. Also, the elastic apparatus comprises two lower ends, each positioned below one of the guidance shafts. Each of the lower ends are adapted to engage each of the grooves, one at a time. The grooves are positioned on each lateral side of the shell base portion substantially along an arc having a radius equal to the distance between the lower ends and the transverse journal. Each of the grooves have substantially the shape of a portion of a sphere.

In still another embodiment the elastic apparatus comprises a substantially rectangular ring comprising major and minor sides. The major sides each comprise a spring jack. One of the minor sides comprises a first journal pivotally connecting the elastic apparatus to the upper portion of the boot at one of the connection points. The other of the minor sides comprises a second journal pivotally connecting the elastic apparatus to the shell base portion of the boot at the other of the connection points.

In this embodiment the elastic apparatus further comprises two substantially U-shaped elements each having a transverse portion and two longitudinal portions. Each longitudinal portion of each substantially U-shaped element comprises an end, and each transverse portion comprises one of the journals. Also, each spring jack is positioned between and connects one of the ends of each substantially U-shaped element. In addition, the elastic apparatus further comprises two casings, each of which houses one of the spring jacks. Each casing freely turns on the ends of one of the substantially U-shaped elements. Also, each casing comprises a threaded portion. The ends of the other of the substantially U-shaped element comprises a threaded portion complementary to the threaded portion of the casings.

Also in this embodiment the upper portion comprises a track comprising a plurality of spaced apart notches, each of which is adapted to engage the first journal. Engagement of the first journal in one of the notches pivotally connects the elastic apparatus to the upper portion of the boot. In addition, the track comprises means for adjusting the height of the first journal along the front of the upper portion of the boot. In addition, the shell base portion comprises a first track comprising a plurality of spaced apart notches. These notches are spaced apart along the longitudinal axis of the shell base portion. Each of the notches is adapted to engage the second journal such that engagement of the second journal in one of the notches pivotally connects the elastic apparatus to the shell base portion of the boot. Also, the track comprises means for adjusting the height of the second journal along the front of the shell base portion of the boot. In addition, the upper portion comprises a second track comprising a plurality of spaced apart notches, each of which is adapted to engage the first journal. Engagement of the first journal in one of the notches pivotally connects the elastic apparatus to the upper portion of the boot. The second track also comprises means for adjusting the height of the first journal along the front of the upper portion of the boot. As a result, the direction of the elastic force generated by the elastic apparatus on the boot is altered by changing the notch with which one or both of the first and second journals engage.

Each track comprises first, second, third and fourth notches. The first notch on the first track is higher than the second notch on the first track. Similarly, the second notch on the first track is higher than the third notch on the first track, and the third notch on the first track is higher than the fourth notch on the first track. Also, the first notch on the second track is higher than the second notch on the second track, the second notch on the second track is higher than the third notch on the second track, and the third notch on the second track is higher than the fourth notch on the second track. The elastic apparatus, and the shell base and upper portions of the boot are configured so as to comprise means for permitting: simultaneous engagement of the first journal with the first notch on the second track and of the second journal with the first notch on the first track; simultaneous engagement of the first journal with the second notch on the second track and of the second journal with the second notch on the first track; simultaneous engagement of the first journal with the third notch on the second track and of the second journal with the third notch on the first track; and simultaneous engagement of the first journal with the fourth notch on the second track and of the second journal with the fourth notch on the first track.

In addition, in this embodiment the elastic apparatus, and the shell base and upper portions of the boot are configured so as to comprises means for permitting simultaneous engagement of the first journal with any of the notches on the second track and of the second journal with any of the notches on the first track. As a result, the strength and direction of the elastic force will vary in response to placing the first journal into a notch identified by a number different than the notch the second journal engages.

In addition, the elastic apparatus can further comprise means for adjusting the length of the major sides of the rectangular ring. In order to accomplish this, the elastic apparatus further comprises two rods connected to each journal. Further, the adjusting means comprises a nut and a bolt. The nut comprises a casing for the spring jack. As a result, the casing comprises a threaded portion. The bolt comprises the end of the rods. The the end of the rods comprises a threaded portion adapted to engage the threaded portion of the casings.

In still another embodiment the upper portion of the boot comprises a plurality of spaced apart grooves. The upper portion of the boot further comprises a front portion having two lateral sides. Also, the shell base portion comprises an upper portion corresponding to an instep zone of the foot of a skier, and the upper portion of the shell base portion comprises two lateral sides. In this embodiment the elastic apparatus comprises two springs, and two guidance shafts. Each spring is attached to one of the guidance shafts, and each guidance shaft is positioned on a different lateral side of the upper portion of the shell base portion. Each guidance shaft also extends upwardly along a different lateral side of the front portion of the upper portion of the boot toward one of the grooves. In addition, each spring is coiled around one of the guidance shafts, and the elastic apparatus further comprises two rear ends, each of which are attached to one of the guidance shafts. Each rear end comprises a spur having a configuration complementary to the grooves so as to be adapted to engage the grooves. In this embodiment the boot further comprises a journal positioned at the connection point between the elastic apparatus is pivotally connected to the shell base portion by the journal and the journal is fixed on the shell base. In addition, the elastic apparatus further comprises a right angle element having first and second portions at substantially right angles to each other. The first portion has an opening therein adapted to receive one of the guidance shafts, and the second portion has an opening therein adapted to receive the journal therein.

As noted above the the journal is positioned at the connection point between the elastic apparatus and the shell base portion, and the elastic apparatus is pivotally connected to the shell base portion by the journal. In this embodiment the elastic apparatus further comprises two rear ends, each of which are attached to one of the guidance shafts. Each rear end comprises a spur adapted to engage the grooves, and the plurality of grooves are positioned on each lateral side of the front of the upper portion of the boot along a curved sector which is substantially part of a sphere having a radius substantially equal to the distance between the rear ends and the journal. In one embodiment the boot further comprises an element in the shape of a substantially spherical sector comprising the grooves. This element is a separate element from the upper portion of the boot and is attached onto the upper portion of the boot. In an alternative embodiment, the curved sector comprising the grooves is integrally molded with the upper portion of the boot.

In still another embodiment the upper portion of the boot comprises a front portion having two lateral sides, and the two lateral sides each comprise a plurality of spaced apart grooves. In this embodiment the elastic apparatus comprises a substantially rigid stirrup and at least one spring. Also, the shell base portion comprises a housing for housing the at least one spring. The housing has an oblong slot therein, and the stirrup has the shape of a part of a trapezoid comprising a minor base and two lateral sides extending from either side of the minor base. The minor base comprises a transverse arm comprising a journal pivotally attaching the elastic apparatus to the shell base portion. The transverse arm is positioned in the oblong slot in the housing. The oblong slot is longer than the transverse arm whereby the transverse arm is adapted to be translationally displaced in the oblong slot. The two lateral sides of the stirrup each comprise a transmission arm extending upwardly from the transverse arm on different lateral sides of the front portion of the upper portion of the boot toward one of the grooves.

Each transmission arm comprises an end portion adapted to engage the grooves. In addition, the at least one spring is positioned in the housing so as to elastically bias the transverse arm against translational displacement in the oblong slot. Also, each transmission arm comprises an end comprising a spur of complementary configuration to the configuration of the grooves so that the spur is adapted to engage each of the grooves. Furthermore, the boot can also comprise in this embodiment means for adjusting the elastic force generated by the at least one spring. This adjusting means comprises for limiting the translational displacement of the transverse arm in the oblong slot. The adjusting means can also comprises a nut and bolt combination. The bolt is attached to the at least one spring, and the bolt compresses the spring in response to rotation of the nut.

Each transmission arm comprises an end portion adapted to engage the grooves. The plurality of grooves are positioned on each lateral side of the front portion of the upper portion of the boot substantially along a substantially spherical sector having a radius substantially equal to the distance between the end portions of the transmission arms and the journal. In one embodiment the boot further comprises an element in the shape of a substantially spherical sector comprising the grooves. This element element is a separate element from the upper portion of the boot and is attached onto the upper portion of the boot. Alternatively, the substantially spherical sector comprising the grooves is integrally molded with the upper portion of the boot.

In still another embodiment the invention is directed to a ski boot for surrounding the foot and lower leg of a skier. The boot is adapted to be used with an elastic apparatus for controlling the flexion of the boot. The boot comprises a shell base portion, an upper portion which is adapted to flex with respect to the shell base portion, and means for pivotally attaching the elastic apparatus to one of the portions of the boot. The other portion of the boot comprises a plurality of spaced apart portions, each of which is adapted to separately engage the elastic apparatus. The plurality of spaced apart portions extend substantially along a portion of a substantially spherical arc having a radius substantially equal to the distance from the portions to the pivotal attaching means.

The invention also relates to such a ski boot in combination with the elastic apparatus. In addition, in both of these embodiments, the plurality of spaced apart portions each comprises a groove, and the plurality of spaced apart grooves are positioned on either the shell base portion of the boot or the upper portion of the boot.

BRIEF DESCRIPTION OF THE DRAWINGS

The characteristics of the invention and its advantages will become evident from the detailed description which follows with reference to the attached drawings in which:

FIG. 1 is a schematic view illustrating a ski boot comprising an apparatus for controlling and adjusting the flexion of the boot according to the invention;

FIG. 1*a* is a partial cross-sectional detailed view along line "a—a" of FIG. 1;

FIG. 2 is a schematic view of the apparatus of FIG. 1 which shows the various flexion of the boot depending upon the different positions occupied by the apparatus;

FIG. 2*a* is a schematic view of a means to vary the point of attachment of one end of the elastic apparatus on the upper of the boot;

FIG. 3 is a schematic view of a second embodiment of the present invention;

FIG. 5 is a schematic view of another embodiment of a boot according to the present invention.

FIG. 6 is a schematic cross-sectional side view of an alternative embodiment of the elastic apparatus illustrated in FIG. 5 in which the elastic system is composed of synthetic elastic materials in which the anchoring zones are reversed as compared to the embodiment illustrated in FIG. 5.

DETAILED DESCRIPTION OF THE INVENTION

Figure 4:
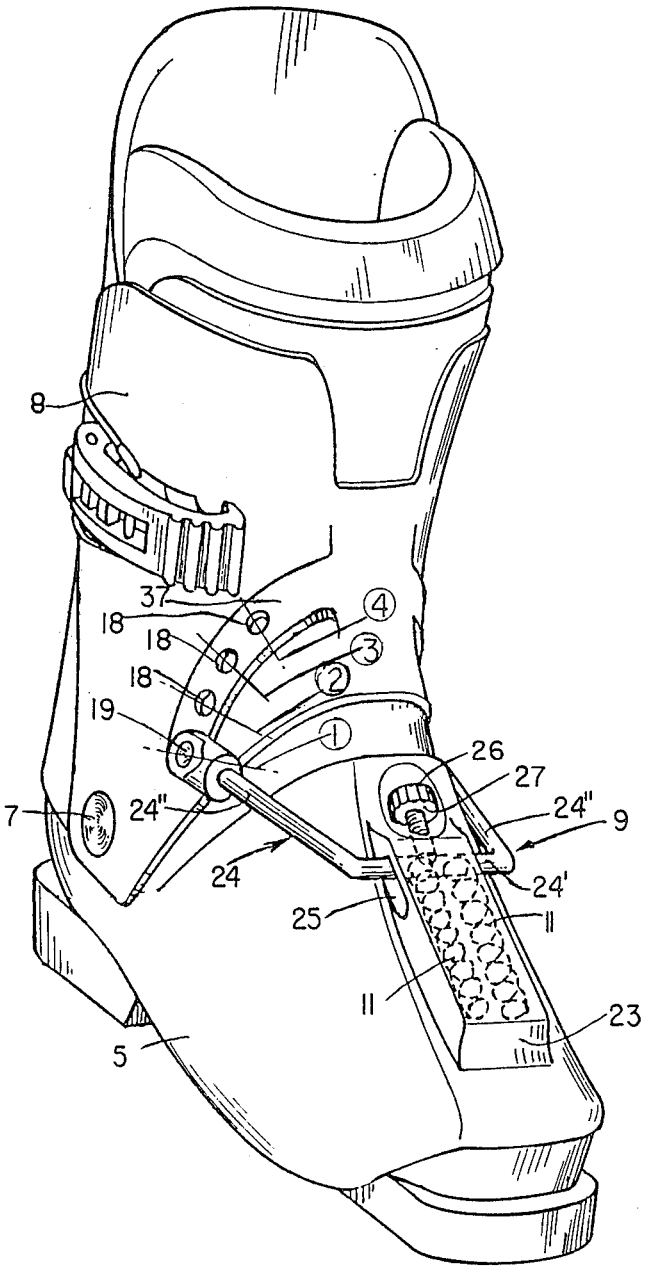
FIG. 4 is a schematic view of a third embodiment of the present invention.

FIG. 1 illustrates a first embodiment of a ski boot and elastic apparatus of the present invention. The boot comprises in a known manner a rigid shell base 5 and an upper 8. Shell base 5 surrounds the foot of the skier and upper 8 surrounds the foot of the skier. Shell base 5 comprises a sole 6. Upper 8 is journalled on sole 6 around a transverse journal 7. Upper 8 comprises a cuff and a rear spoiler. A means of mechanical restraint is provided, which is illustratively shown by at least one elastic apparatus 9. Elastic apparatus 9 comprises two ends 9' and 9''. End end 9' is integral with shell base 5 at points or positions 1, 2, 3 or 4 in the swivel openings or grooves 5' in shell base 5. End 9'' of elastic apparatus 9 is integral with upper 8 via journal 10 which pivotally attaches end 9'' to upper 8. Elastic apparatus 9 is adapted to pivot around journal 10 so that end 9' can be connected to shell base 5 at positions 1, 2, 3, or 4. Elastic apparatus 9 permanently biases upper 8 to a predetermined advancement angle with respect to a vertical axis.

The resistance moment of upper 8 opposing flexion of the skier's leg (exerted by the skier on upper 8) is equal to the product of the force exerted by elastic apparatus 9 and the lever arm. The lever arms is the perpendicular distance between journal axis 7 and the line joining points 10 and 5', i.e. a line joining the points at which elastic apparatus 9 is integral with upper 8 and shell base 5. The elastic force emitted by the apparatus is generated along this line between journal 10 and grooves 5'.

It has been explained above that the advancement angle of the upper varies depending upon the conditions of use. Further, it is desireable to produce a flexion of the upper frontwardly from this angle against a resistance moment of the upper which can be varied in a range which is substantially greater than the one of the resistance moment known previously in the art except for French Patent Application No. 84.13152. One can theoretically alter the resistance moment by changing the force applied at the lever arm, by changing the lever arm, or by changing both the force and the lever arm simultaneously.

Assuming that the lever arm is either constant or only slightly changing, i.e., that positions 1, 2, 3 and 4 comprise a single fixed position, it is the force which must vary in a relatively substantial fashion. However, except for the embodiment disclosed in French Application No. 84.13152, is not possible to increase the force of the spring without relying upon an elastic apparatus having exceptional characteristics unsuited for use in an inexpensive ski boot. This leads to eliminating this theoretical solution at the outset. It is also impractical to increase the resistance moment by increasing only the lever arm substantially. This is because the lever arm cannot be increased without rendering the construction of the boot practically impossible, due to the cumbersomeness of the resulting boot. With greater reason it is also necessary to eliminate the case where one of the factors, i.e., the force or the lever arm decreases when the advancement angle increases.

As a result of this analysis, Applicants have developed an advantageous solution. The solution comprises varying the resistance moment generated by the apparatus to oppose flexion of the skier's leg by varying the lever arm by varying the direction of a constant force applied by the elastic apparatus to the boot.

This solution is illustrated in a schematic manner in FIG. 2 where four different applications points 5' are illustrated. Each application point is a point at which a spring 11 of elastic apparatus 9 can apply a force on shell base 5. These force points are identified by positions 1, 2, 3, and 4. By passing application point 5' of apparatus 9 on base 5 successively through positions 1–4 lever arm 12 can substantially double from a value of $l_1$, to a value of $l_4$. $l_4$ is approximately equal to $2 \times l_1$. In addition the maximum flexion of spring 11, shown by arrows $F_1$–$F_4$, can also vary by the same order of magnitude. The arrows shown at $F_1$–$F_4$ corresponds to each position 1–4 for the maximum frontward displacement of the edge of upper 8 toward shell base 5, this displacement being projected on the line of force generated by spring 11 at rest (thus for a selected advancement angle). Arrows $F_1$–$F_4$ are proportional to the maximum effective force exerted by spring 11. As a result, it will be evident that in passing from position 1, already at a maximum force, to position 4, the resulting maximum moment obtained can, by this arrangement, be substantially increased (both the force and the lever arm are doubled). As a result, the ratio between the greatest and the smallest resistance moments of the boot can easily reach an order of magnitude of ten between position 1 at rest and position 4 at maximum flexion $F_4$, due to the force at position 1 being able to be well below $F_1$.

An embodiment of the device described with reference to schematic FIG. 2 is illustrated in FIG. 1. Preferably apparatus 9 comprises two springs 11 or other elastic elements positioned on both sides of the instep of the boot. This arrangement is preferable to the use of a single spring (although the use of a single spring is also within the scope of the present invention) because a single spring would almost necessarily be positioned on top of the upper which is cumbersome. The use of two springs, on both lateral sides of the instep (on the upper and the shell base), however, allows for an easy integration of elastic apparatus 9 with the general line of the boot, thus lessening the cumbersomeness of the springs and producing a more pleasing aesthetic appearance. Furthermore, the embodiment illustrated in FIG. 2 has the advantage of also using the inherent variation in the lateral rigidity of the boot to take into account and/or neutralize any bias tending to laterally angularly displace upper 8 with respect to shell base 5. In the illustrated embodiment helicoidal springs 11 are used which are lodged in jacks. Each spring 11 is biased by a piston 13 integral with a shank or shaft 14. The two shafts 14 of pistons 13 are journalled at their ends 9'' around a journal 10 attached to the cuff of upper 8. The other end 9' of elastic apparatus 9, which is the end portion of the jacks, can rest in any one of four grooves 5' identified as support positions 1, 2, 3 and 4. These grooves are arranged on each lateral side of shell base 5 in front of the flexion fold of the instep. FIG. 1*a* illustrates an enlarged view of the engagement between end 9' and support point 5'.

Depending upon the skill level and individual requirements of the skier and the suspected conditions of the course which will be run, the skier may select the desired rigidity of the boot by selecting, just before beginning the course, the support position (i.e. 1, 2, 3 or 4) of the jack which is considered to be optimum. It is even possible for the skier having morphological problems, to be able to at least partially minimize these problems by adjusting the wedging or lateral angular inclination of the upper, by selecting the lateral rigidity of the boot (i.e. the resistance of the boot to lateral angular displacement) by choosing support points 1, 2, 3, and 4 on each side of the boot which are not identical.

FIG. 2*a* schematically illustrates means for varying the position at which end 9'' is integral with upper 8. This means adjusts the height of end 9'' along the front portion of upper 8. To accomplish this, a rib 8' is provided on upper 8 and a slot 15 is provided in rib 8'. Further, an adjustment device 16 of a known type is attached to end 9''. This adjustment device can be, for example, a nut and bolt, adjustment wedges of different thicknesses, etc. All of these adjustment devices translationally displace end 9'' along the length of the slot 15. If a nut and bolt are used, end 9'' can be attached to the bolt, and the height of end 9'' would be translationally displaced in response to the rotation of the nut.

In this embodiment elastic apparatus is in the form of a stirrup having the shape of part of a trapezoid comprising a minor base and two lateral sides extending downwardly from the base. The minor base comprises journal 10, and the two lateral sides each comprise shaft 14, piston 13, spring 11, and the casing housing spring 11 and piston 13.

FIGS. 3 and 4 illustrate respectively two variations of another embodiment of the present invention. In this embodiment, the application point of the spring 11 on base 5 is fixed on shell base 5 at journal 17, which pivotally connects one end of elastic apparatus 9 to shell base 5. In this embodiment elastic apparatus 9 can be a jack comprising helical spring 11 wound around a shaft or shank 22 having an end 20. End 20 is journalled on shell base 5 by journal 17. End 20 is attached to journal 17 by means of a right angle linkage element 21 having two portions at right angles to each other. One portion of element 21 has an opening therein for receiving end 20, and the other portion of element 21 also has an opening therein for engaging journal 17.

In this embodiment, unlike FIGS. 1 and 2, it is the other point 18 at which elastic apparatus 9 engages the cuff of the upper 8 whose position is adjustable. The shaft of each jack 9 carries at its end 19 a spur or projection 19' which is preferably cylindrical and is adapted to be lodged in one of the four spaced apart grooves 18 of corresponding configuration defining a transverse journal on upper 8, as is shown in FIG. 3*a*. Grooves 18 comprise four progressive adjustment positions for the rigidity of the boot: 1, 2, 3, and 4. Spur 19' and elastic apparatus 9 are adapted to engage each of these grooves, one at a time. Depending upon the groove that is chosen, the rigidity of the boot will be determined.

The plurality of grooves 18 are either molded with the upper or are part of a separate substantially spherical sector-shaped element which is attached to the upper after the upper is manufactured. These grooves determine the progressive adjustment positions 1, 2, 3, and 4, which determine the rigidity of the boot.

Although not shown in FIG. 3, an apparatus having two springs 11 on both sides of the instep can be provided to the embodiment shown in FIG. 3, thereby producing the same advantages as in the preceding embodiment.

Furtheremore, in FIG. 3 spring 11 of apparatus 9 is shown as being supported on guidance shaft 22. Of course, it is within the scope of the invention for spring 11 to also be lodged in a tubular container which those of skill in the art will understand without further explanation.

The embodiment shown in FIG. 4, is similar to FIG. 3, for example, in its design for the point of application 18 of the force of spring 11 on upper 8. However, in this embodiment one or more springs themselves 11 are housed in an opening or housing 23 in shell base 5 in front of the instep. Springs 11 bias a stirrup in the form of a substantially U-shaped bar or double shaft 24. Bar 24 comprises a transverse bar 24' and two arms 24'' extending from either side of transverse bar 24 to different lateral sides of the front of upper 8. More specifically, springs 11 directly bias transverse bar 24' against translational displacement in an oblong slot 25 in housing 23. Bar 24' is free to rotate in a slot 25 and can be translationally displaced against springs 11. As a result, transverse bar 24' comprises the journal for pivotally attaching elastic apparatus 9 to shell base 5. In addition, arms 24'' are supported on cuff 8 in one of a plurality of spaced apart grooves as in the preceding embodiment.

The advantage of this embodiment over the preceding embodiment is that the instantaneous axis of rotation of shaft 24 on shell base 5 can be displaced translationally forwardly during compression, which increases the amount with which the flexional angle can be varied from an initial advancement angle of upper 8.

In the embodiments of the apparatus shown in FIGS. 3 and 4 which have been described above, the ability to vary the position of the application points, identified by positions 1, 2, 3 and 4, of the elastic apparatus on upper 8 is accomplished by the use of a plurality of openings 18 which serve as a hook or attachment for spur 19' for each respective point of application of the elastic apparatus on the upper. These grooves 18 are arranged on upper 8 along a sector 37 which is substantially spherical and concentric with respect to journal 24' and journal 17 on the shell base 5. As a result, the distance from the journal to each of the grooves is substantially the same. Consequently, the attaching of spur 19 on upper 8 can be performed in accordance with the more or less curved form of the upper and simultaneously without requiring a change in the advancement angle of upper 8 with respect to shell base 5. This result can also be achieved in the embodiments of FIGS. 1 and 2.

In the embodiments illustrated in FIGS. 1 and 2 the application points of elastic apparatus 9 on shell base 5, which are defined by positions 1, 2, 3, and 4 comprise substantially spherically shaped cut-outs or grooves 5' having a shape which is substantially complementary to that of end 9' of elastic apparatus 9. These cut-outs are positioned along an arc that is substantially spherical and concentric to journal 10. As a result, the distance from each groove 5 to journal 10 is substantially the same. Further, in the embodiments illustrated in FIGS. 1–4, the "active" length of apparatus 9, i.e., the distance separating application points 10 and 5' in FIG. 1, application points 17 and 18 in FIG. 3, and application points 18 and 24' in FIG. 4, (i.e. the distance separating the point of contact of apparatus 9 on upper 8 and base 5) is constant for all positions 1, 2, 3, and 4 for an initially set elastic force and advancement angle. It should be noted that this distance will change during forward flexional movements of the upper which occur during skiing.

In addition, in the embodiment shown in FIG. 4, an adjustment apparatus 26 for adjusting the advancement angle of upper 8 with respect to shell base 5 can be associated with apparatus 9 to simultaneously adjust the advancement angle and the initial force of springs 11. In FIG. 4 adjustment apparatus 26 comprises a screw 27 which is adapted to push bar 24' against springs 11 without modifying the "active" length of apparatus 9 because the distance between bar 24' and spur 19 remains constant.

Finally, FIG. 5 illustrates another embodiment of the boot according to the present invention which achieves the desired results by the use of an elastic device 9 in which both ends can be displaced on the boot. Elastic device 9 comprises springs 11. The direction of the force applied by springs 11 to the boot can be varied (thus influencing the lever arm to which it is applied) by simultaneously modifying the position of the points identified by the positions 1, 2, 3, and 4 and of the points identified by positions 1', 2', 3', and 4'. Points 1, 2, 3, and 4 are the points on upper 8 at which elastic device 9 is integal with or connected to upper 8. Points 1', 2', 3', and 4' are the points on base 5 at which elastic device 9 is integral with or connected to base 5. To accomplish this result two notched track sectors 28 and 29 are respectively positioned on the front portion of upper 8 and on the upper portion of the front of shell base 5. In addition, two substantially U-shaped metal arms 30 and 31 are provided. Arm 30 has a transverse portion 30' and arm 31 has a transverse portion 31'. Transverse portions 30' and 31' are adapted to engage each of the notches in sectors 28 and 29, respectively. Elastic means 11 are interposed between the ends of the metal arms 30 and 31 which face one another. Transverse portion 30' of the metal element 30 engages one of notches 28' of notch track 28 at position 1, 2, 3, or 4. Transverse arm 31' is adapted to engage one of notches 29' so as to be attached at one of points 1', 2', 3', or 4'' on shell base 5. Each position 1, 2, 3, and 4 comprises a different notch in track 28.

Elastic apparatus 9 in this embodiment comprises a substantially rectangular ring whose major sides comprise spring jacks, and whose minor sides comprise journals 30' and 31'.

In addition, positions 1, 2, 3, and 4 respectively correspond to positions 1', 2', 3' and 4' formed by notches 29' of the notch track 29. Further, position 4 on track 28 is higher than position 3 on track 28, position 3 on track 28 is higher than position 2 on track 28, and position 2 is higher than position 1 on track 28. Similarly, position 4' on track 29 is higher than position 3' on track 29, position 3' on track 29 is higher than position 2' on track 29, and position 2 on track 29 is higher than position 1 on track 29. In addition, the boot is constructed so that normally positions 1 and 1' correspond of attachment points 28' and 29' of elastic apparatus 9. Points 1 and 1' define a predetermined direction for the elastic force produced by apparatus 9. This elastic force produces the resistance force of the boot and a predetermined resistance moment to resist forward flexion of the leg. This resistance moment can be adjusted as a function of the various orientations defined by the points 2, 2', 3, 3', and 4, 4'. In other words, the elastic apparatus and the boot are adapted so that transverse arms 30' and 31, respectively engage points 2, 2'; 3, 3'; and 4, 4'.

This embodiment can also adjust the resistance moment in another manner by subjecting spring 11 to an initial prestress. This is accomplished by compressing spring 11, for example, by positioning transverse portion 31' at position 3' and positioning transverse portion 30' at position 2, as illustrated in FIG. 5. When prestressing the spring, it is advantageous not to influence the advancement position of the upper 8 with respect to the shell base 5. To this end, a means is provided for linking portions of elastic apparatus 9 so as to allow for adjustment of the advancement of upper 8. This adjustment is obtained by providing a casing 32 for springs 11 which freely turns on the ends 33 of substantially U-shaped iron arm 30. Also provided in casing 32 is a threaded portion 34 adapted to cooperate with ends 35 of the substantially U-shaped iron arm 31. Ends 35 are provided with a corresponding threading. Such a construction also makes it possible, depending upon whether casings 32 are screwed to a greater or lesser extent on ends 35 of arm 31, to modify the initial active length of apparatus 9 included between its transverse arms 30' and 31'. Altering of the initial active length of apparatus 9 modifies the relative position of upper 8 which pivots on its axis 7 with respect to the shell base 5. As a result, the "active" length of the apparatus can be altered simultaneously with the prestressing of spring 11 and thus its initial elastic force. Further, the number of possible adjustments that are possible in the orientation of the resistance force in this embodiment is sixteen times larger than the previous embodiments.

Of course, the apparatus for controling the flexion according to the present invention described above are not limited to the use of helicoidal metal compression springs. It is also within the scope of the invention to replace these springs with synthetic elastic materials 36 which produce an elastic force when either compressed or extended by simply reversing the anchorage points of these elastic components made of synthetic materials 36 within the elastic apparatus as is schematically illustrated in FIG. 6.

Furthermore, although the invention has been described with reference to the specific means, methods, and embodiments discussed above with respect to the attached drawings shown by way of non-limiting example, it is to be understood that the invention is not limited to the embodiments shown and described, nor to the specific materials disclosed, and extends to all equivalents within the scope of the claims.

What is claimed is:

1. A ski boot for surrounding the foot and the lower leg of a skier, wherein said boot comprises:

(a) a shell base portion;

(b) an upper portion, wherein said upper portion is adapted to flex with respect to said shell base portion; and (c) an elastic apparatus for controlling the flexion of said upper portion, wherein said elastic apparatus is secured to each of said portions at a connection point, wherein said elastic apparatus generates an elastic force directed toward said connection point of said elastic apparatus with one of said portions of said boot, wherein the position of said connection point of said elastic apparatus with the other portions of said boot is adjustable to correspondingly vary the orientation of said elastic force.

2. The boot defined by claim 1 wherein said boot further comprises means for adjusting said connection point of said elastic apparatus with the other of said portions of said boot.

3. The boot defined by claim 2 wherein said other of said portions of said boot comprises a plurality of spaced apart elements, each of which is adapted to receive a complementary shaped portion of said elastic apparatus.

4. The boot defined by claim 3 wherein said plurality of spaced apart elements each comprises a groove adapted to receive a complementary shaped portion of said elastic apparatus.

5. The boot defined by claim 1 wherein said upper portion is adapted to be positioned with respect to said shell base portion at an advancement angle forming an angle with respect to a vertical axis, wherein said upper portion is adapted to flex away from said advancement angle in response to a force from the leg of said skier, wherein said elastic apparatus generates an elastic force directed toward said connection point of said elastic apparatus with one of said portions of said boot for a given advancement angle of said upper portion with respect to said shell base portion.

6. The boot defined by claim 5 wherein said boot comprises a rear portion, wherein said upper portion is journalled at least partially on said shell base portion around a substantially horizontal axis, wherein said upper portion comprises at least a portion surrounding the front of the lower leg of the skier, wherein said boot further comprises means for permitting insertion of the foot of said skier from said rear portion of said boot.

7. The boot defined by claim 6 wherein said elastic apparatus comprises:

at least one spring; and at least one piston engaging said at least one spring, wherein said elastic apparatus has a longitudinal axis extending through said at least one spring and said at least one piston, wherein said longitudinal axis defines the line of application of said elastic force of said elastic apparatus to at least one of said boot portions, wherein said elastic force opposes the flexion of the lower leg of the skier and the consequent flexion of said upper portion of said boot.

8. The boot defined by claim 7 wherein said elastic apparatus further comprises:

a jack housing said at least one spring and said at least one piston; and a shaft attached to said piston and extending out of said jack, wherein said longitudinal axis extends through said shaft.

9. The boot defined by claim 6 wherein said elastic apparatus comprises an elastic compression spring.

10. The boot defined by claim 6 wherein said elastic apparatus comrpises an extension spring.

11. The boot defined by claim 6 wherein said position of said connection point of said elastic apparatus with the other of said portions of said boot is adjustable to four different positions on said other portion of said boot.

12. The boot defined by claim 6 further comprising:

a transverse journal, wherein said transverse journal is positioned at said connection point between said elastic apparatus and said one of said portions of said boot, wherein said elastic apparatus is pivotally connected to said one of said portions of said boot by said transverse journal.

13. The boot defined by claim 12 further comprising:

means for adjusting the height of said transverse journal.

14. The boot defined by claim 13 wherein said one of said portions of said boot comprises said upper portion, wherein said other of said portions of said boot comprises said shell base portion, wherein said adjusting means adjust the height of said transverse journal along the front of said upper portion.

15. The boot defined by claim 14 wherein said shell base portion comprises a plurality of spaced apart grooves, each of which is adapted to receive one end of said elastic apparatus so that each of said grooves comprises a connection point of said elastic apparatus on said shell base portion.

16. The boot defined by claim 12 wherein said one of said portions of said boot comprises said shell base portion, wherein said other of said portions of said boot comprises said upper portion.

17. The boot defined by claim 16 further comprising means for adjusting the height of said transverse journal, wherein said shell base portion comprises an upper portion, wherein said adjusting means adjusts the height of said transverse journal along the front of said shell base portion.

18. The boot defined by claim 17 wherein said upper portion of said boot comprises a plurality of spaced apart grooves, each of which is adapted to receive one end of said elastic apparatus so that each of said grooves comprises a connection point of said elastic apparatus on said upper portion of said boot.

19. The boot defined by claim 12 wherein said shell base portion comprises a plurality of spaced apart grooves, wherein said elastic apparatus comprises a stirrup having the form substantially of three sides of a trapezoid, wherein said stirrup comprises a minor base and two sides, wherein said minor base comprises said transverse journal, wherein said journal is integral with said upper portion, wherein each of said two sides comprises a guidance shaft and a spring attached to said guidance shaft, wherein each guidance shaft extends from said transverse journal downwardly toward the bottom of a different side of said shell base portion toward one of said grooves.

20. The boot defined by claim 19 wherein said upper portion of said boot comprises a rib having an oblong slot therein, wherein said boot further comprises means for adjusting the height of said transverse journal along the the front of said upper portion of said boot, wherein said adjusting means comprises means for translationally displacing said transverse journal in said slot.

21. The boot defined by claim 19 wherein said elastic apparatus comprises two lower ends, each positioned below one of said guidance shafts, wherein each of said lower ends are adapted to engage each of said grooves, one at a time, wherein said grooves are positioned on each lateral side of said shell base portion substantially along an arc having a radius equal to the distance between said lower ends and said transverse journal.

22. The boot defined by claim 21 wherein each of said grooves have substantially the shape of a portion of a sphere.

23. The boot defined by claim 6 wherein said elastic apparatus comprises a substantially rectangular ring comprising major and minor sides, wherein said major sides each comprise a spring jack, wherein one of said minor sides comprises a first journal pivotally connecting said elastic apparatus to said upper portion of said boot at one of said connection points, wherein the other of said minor sides comprises a second journal pivotally connecting said elastic apparatus to said shell base portion of said boot at the other of said connection points.

24. The boot defined by claim 23 wherein said elastic apparatus further comprises two substantially U-shaped elements each having a transverse portion and two longitudinal portions, wherein each longitudinal portion of each substantially U-shaped element comprises an end, wherein each transverse portion comprises one of said journals, wherein each spring jack is positioned between and connects one of the ends of each substantially U-shaped element.

25. The boot defined by claim 24 wherein said elastic apparatus further comprisees two casings, each of which houses one of said spring jacks, wherein each casing freely turns on the ends of one of said substantially U-shaped elements, wherein each casing comprises a threaded portion, wherein the ends of the other of said substantially U-shaped elements comprises a threaded portion complementary to said threaded portion of said casings.

26. The boot defined by claim 23 wherein said upper portion comprises a track comprising a plurality of spaced apart notches, each of which is adapted to engage said first journal, wherein engagement of said first journal in one of said notches pivotally connects said elastic apparatus to said upper portion of said boot, wherein said track comprises means for adjusting the height of said first journal along the front of said upper portion of said boot.

27. The boot defined by claim 23 wherein said shell base portion comprises a first track comprising a plurality of spaced apart notches, wherein said notches are spaced apart along the longitudinal axis of said shell base portion, wherein each of said notches is adapted to engage said second journal, wherein engagement of said second journal in one of said notches pivotally connects said elastic apparatus to said shell base portion of said boot, wherein said track comprises means for adjusting the height of said second journal along the front of said shell base portion of said boot.

28. The boot defined by claim 27 wherein said upper portion comprises a second track comprising a plurality of spaced apart notches, each of which is adapted to engage said first journal, wherein engagement of said first journal in one of said notches pivotally connects said elastic apparatus to said upper portion of said boot, wherein said track comprises means for adjusting the height of said first journal along the front of said upper portion of said boot, whereby the direction of said elastic force generated by said elastic apparatus on said boot is altered by changing the notch with which one or both of said first and second journals engage.

29. The boot defined by claim 28 wherein each track comprises first, second, third and fourth notches, wherein said first notch on said first track is higher than said second notch on said first track, said second notch on said first track is higher than said third notch on said first track, said third notch on said first track is higher than said fourth notch on said first track, wherein said first notch on said second track is higher than said second notch on said second track, said second notch on said second track is higher than said third notch on said second track, said third notch on said second track is higher than said fourth notch on said second track, wheein said elastic apparatus, and said shell base and upper portions of said boot are configured so as to comprise means for permitting:

simultaneous engagement of said first journal with said first notch on said second track and of said second journal with said first notch on said first track;

simultaneous engagement of said first journal with said second notch on said second track and of said second journal with said second notch on said first track;

simultaneous engagement of said first journal with said third notch on said second track and of said second journal with said third notch on said first track; and simultaneous engagement of said first journal with said fourth notch on said second track and of said second journal with said fourth notch on said first track.

30. The boot defined by claim 29 wherein said elastic apparatus, and said shell base and upper portions of said boot are configured so as to comprises means for permitting simultaneous engagement of said first journal with any of said notches on said second track and of said second journal with any of said notches on said first track, whereby the strength and direction of said elastic force will vary in response to placing said first journal into a notch identified by a number different than the notch said second journal engages.

31. The boot defined by claim 23 wherein said elastic apparatus further comprises means for adjusting the length of said major sides of said rectangular ring.

32. The boot defined by claim 31 wherein said elastic apparatus further comprises two rods connected to each journal, wherein said adjusting means comprises a nut and a bolt, wherein said nut comprises a casing for said spring jack, wherein said casing comprises a threaded portion, wherein said bolt comprises the end of said rods, wherein the end of said rods comprises a threaded portion adapted to engage said threaded portion of said casings.

33. The boot defined by claim 6 wherein said upper portion of said boot comprises a plurality of spaced apart grooves, wherein said upper portion of said boot further comprises a front portion having two lateral sides, wherein said shell base portion comprises an upper portion corresponding to an instep zone of the foot of a skier, wherein said upper portion of said shell base portion comprises two lateral sides, wherein said elastic apparatus comprises:

two springs; and two guidance shafts, wherein each spring is attached to one of said guidance shafts, wherein each guidance shaft is positioned on a different lateral side of said upper portion of said shell base portion, wherein each guidance shaft also extends upwardly along a different lateral side of said front portion of said upper portion of said boot toward one of said grooves.

34. The boot defined by claim 33 wherein each spring is coiled around one of said guidance shafts, wherein said elastic apparatus further comprises two rear ends, each of which are attached to one of said guidance shafts, wherein each rear end comprises a spur having a configuration complementary to said grooves so as to be adapted to engage said grooves.

35. The boot defined by claim 33 further comprising:

a journal, wherein said journal is positioned at said connection point between said elastic apparatus and said shell base portion, wherein said elastic apparatus is pivotally connected to said shell base portion by said journal, wherein said journal is fixed on said shell base.

36.The boot defined by claim 35 wherein said elastic apparatus further comprises a right angle element having first and second portions at substantially right angles to each other, wherein said first portion has an opening therein adapted to receive one of said guidance shafts, wherein said second portion has an opening therein adapted to receive said journal therein.

37. The boot defined by claim 33 further comprising:

a journal, wherein said journal is positioned at said connection point between said elastic apparatus and said shell base portion, wherein said elastic apparatus is pivotally connected to said shell base portion by said journal, wherein said elastic apparatus further comprises two rear ends, each of which are attached to one of said guidance shafts, wherein each rear end comprises a spur adapted to engage said grooves, wherein said plurality of grooves are positioned on each lateral side of said front of said upper portion of said boot along a curved sector which is substantially part of a sphere having a radius substantially equal to the distance between said rear ends and said journal.

38. The boot defined by claim 37 further comprising an element in the shape of a substantially spherical sector comprising said grooves, wherein said element is a separate element from said upper portion of said boot and is attached onto said upper portion of said boot.

39. The boot defined by claim 37 wherein curved sector comprising said grooves is integrally molded with said upper portion of said boot.

40. The boot defined by claim 6 wherein said upper portion of said boot comprises a front portion having two lateral sides, wherein said two lateral sides each comprise a plurality of spaced apart grooves, wherein said elastic apparatus comprises a substantially rigid stirrup and at least one spring, wherein said shell base portion comprises a housing for housing said at least one spring, wherein said housing has an oblong slot therein, wherein said stirrup has the shape of a part of a trapezoid comprising a minor base and two lateral sides extending from either side of said minor base, wherein said minor base comprises a transverse arm comprising a journal pivotally attaching said elastic apparatus to said shell base portion, wherein said transverse arm is positioned in said oblong slot in said housing, wherein said oblong slot is longer than said transverse arm whereby said transverse arm is adapted to be translationally displaced in said oblong slot, wherein said two lateral sides of said stirrup each comprise a transmission arm extending upwardly from said transverse arm on different lateral sides of said front portion of said upper portion of said boot toward one of said grooves.

41. The boot defined by claim 40 wherein each transmission arm comprises an end portion adapted to engage said grooves.

42. The boot defined by claim 40 wherein said at least one spring is positiond in said housing so as to elastically bias said transverse arm against translational displacement in said oblong slot.

43. The boot defined by claim 40 wherein each transmission arm comprises an end comprising a spur of complementary configuration to the configuration of said grooves so that said spur is adapted to engage each of said grooves.

44. The boot defined by claim 40 further comprising means for adjusting the elastic force generated by said at least one spring, wherein said adjusting means comprises for limiting the translational displacement of said transverse arm in said oblong slot.

45. The boot defined by claim 44 wherein said adjusting means comprises a nut and bolt combination, wherein said bolt is attached to said at least one spring, wherein said bolt compresses said spring in response to rotation of said nut.

46. The boot defined by claim 40 wherein each transmission arm comprises an end portion adapted to engage said grooves, wherein said plurality of grooves are positioned on each laterial side of said front portion of said upper portion of said boot substantially along a substantially spherical sector having a radius substantially equal to the distance between said end portions of said transmission arms and said journal.

47. The boot defined by claim 46 further comprising an element in the shape of a substantially spherical sector comprising said grooves, wherein said element is a separate element from said upper portion of said boot and is attached onto said upper portion of said boot.

48. The boot defined by claim 46 wherein substantially spherical sector comprising said grooves is integrally molded with said upper portion of said boot.

49. A ski boot for surrounding the foot and lower leg of a skier, wherein said boot is adapted to be used with an elastic apparatus for controlling the flexion of said boot, wherein said boot comprises:

(a) a shell base portion;

(b) an upper portion, wherein said upper portion is adapted to flex with respect to said shell base portion; and (c) means for pivotally attaching said elastic apparatus to one of said portions of said boot, wherein the other portion of said boot comprises a plurality of spaced apart portions, each of which is adapted to separately engage said elastic apparatus, wherein said plurality of spaced apart portions extend substantially along a portion of a substantially spherical arc having a radius substantially equal to the distance from said portions to said pivotal attaching means.

50. The boot defined by claim 49 in combination with said elastic apparatus.

51. The boot defined by claim 49 wherein said plurality of spaced apart portions each comprises a groove.

52. The boot defined by claim 51 wherein said plurality of spaced apart grooves are positioned on said shell base portion of said boot.

53. The boot defined by claim 51 wherein said plurality of spaced apart grooves are positioned on said upper portion of said boot.

54. A ski boot for surrounding the foot and the lower leg of a skier, wherein said boot comprises:

(a) a shell base portion;

(b) an upper portion, wherein said upper portion is adapted to flex with respect to said shell base portion; and (c) an elastic apparatus for controlling the flexion of said upper portion, wherein said elastic apparatus is secured to each of said portions at a connection point, wherein said elastic apparatus generates an elastic force directed toward said connection point of said elastic apparatus with one of said portions of said boot, wherein the position of said connection point of said elastic apparatus with the other of said portions of said boot is adjustable, wherein said other of said portions of said boot comprises a plurality of spaced-apart elements at different positions, each of which is adapted to received a complimentary shaped portion of said elastic apparatus.

* * * * *